US008887678B2

(12) United States Patent
Ozeki

(10) Patent No.: US 8,887,678 B2
(45) Date of Patent: Nov. 18, 2014

(54) LUBRICATING STRUCTURE FOR INTERNAL COMBUSTION ENGINE

(71) Applicant: Suzuki Motor Corporation, Hamamatsu (JP)

(72) Inventor: Hisashi Ozeki, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 15 days.

(21) Appl. No.: 13/755,359

(22) Filed: Jan. 31, 2013

(65) Prior Publication Data

US 2013/0192554 A1 Aug. 1, 2013

(30) Foreign Application Priority Data

Jan. 31, 2012 (JP) ..... 2012-018191

(51) Int. Cl.
*F01M 9/10* (2006.01)
*F01M 11/02* (2006.01)

(52) U.S. Cl.
CPC ..... *F01M 9/101* (2013.01); *F01M 11/02* (2013.01); *F01M 9/105* (2013.01)
USPC ..... 123/90.34; 123/90.38

(58) Field of Classification Search
CPC ..... F01M 9/10; F01M 9/102; F01M 9/101; F01M 9/107; F01M 9/104; F01M 9/105; F01M 9/108; F01M 11/02
USPC ..... 123/90.34, 90.38, 196 R, 196 M
See application file for complete search history.

(56) References Cited

U.S. PATENT DOCUMENTS

| | | | | |
|---|---|---|---|---|
| 4,800,850 | A * | 1/1989 | Yoshida et al. | 123/90.16 |
| 6,263,844 | B1 | 7/2001 | Ozeki et al. | |
| 2011/0079192 | A1 | 4/2011 | Hiramatsu et al. | |

FOREIGN PATENT DOCUMENTS

| | | |
|---|---|---|
| EP | 0461952 A1 | 12/1991 |
| JP | 03-6006 U | 1/1991 |

OTHER PUBLICATIONS

European Search Report, dated Mar. 26, 2013, which issued during the prosecution of European Patent Application No. 13153176.6, which corresponds to the present application.

* cited by examiner

*Primary Examiner* — Zelalem Eshete
(74) *Attorney, Agent, or Firm* — Troutman Sanders LLP

(57) ABSTRACT

There is provided a lubricating structure for an internal combustion engine which has a crankcase, a cylinder block, a cylinder head housing a valve driving device, and a cam housing provided on an upper portion of the cylinder head to support an intake-side camshaft and an exhaust-side camshaft, the lubricating structure including: a main oil passage formed in the cam housing; an oil passage formed in an outer wall upper portion of the cylinder head so as to communicate with the main oil passage; and a pipe connection portion formed so as to allow an external oil pipe to be connected to the oil passage from an outside.

4 Claims, 10 Drawing Sheets

LUBRICATING STRUCTURE FOR INTERNAL COMBUSTION ENGINE

CROSS-REFERENCE TO RELATED APPLICATIONS

This application is based upon and claims the benefit of priority of the prior Japanese Patent Application No. 2012-018191, filed on Jan. 31, 2012, the entire contents of which are incorporated herein by reference.

BACKGROUND OF THE INVENTION

1. Field of the Invention

The present invention relates to a lubricating structure for an internal combustion engine. More particularly, the present invention relates to a lubricating structure for an internal combustion engine in which a cam housing supporting a camshaft is provided on an upper portion of a cylinder head.

2. Description of the Related Art

Internal combustion engines for motorcycles and automobiles generally have a lubricating structure. Such a lubricating structure pumps up by an oil pump a lubricating oil stored in an oil pan provided on a lower surface of a crankcase and supplies the lubricating oil to parts such as a crankshaft in the crankcase, a piston in a cylinder, and a valve driving device in a cylinder head.

As a conventional lubricating structure for an internal combustion engine of this type, there has been publicly known, for example, one which supplies a lubricating oil drawn up by an oil pump to a piston in a cylinder, a valve driving device in a cylinder head, and so on via an oil passage formed in the cylinder head (see Patent Document 1, for instance).

[Patent Document 1] Japanese Utility Model Application Laid-open No. 03-6006

However, in the above-described conventional lubricating structure for the internal combustion engine, the oil passage is formed in the cylinder head. Such a structure imposes a layout restriction on a route, an inside diameter, and so on of the oil passage. Therefore, the oil passage is liable to become excessively long and thin. This has problems of difficulty in reducing resistance when the lubricating oil flows through the oil passage and inability to supply the lubricating oil efficiently to each part.

SUMMARY OF THE INVENTION

The present invention was made to solve the above-described problems and has an object to provide a lubricating structure for an internal combustion engine capable of efficiently supplying a lubricating oil to each part.

To attain the above object, the present invention is a lubricating structure for an internal combustion engine which has a crankcase, a cylinder block, a cylinder head housing a valve driving device, and a cam housing provided on an upper portion of the cylinder head to support a camshaft, the lubricating structure including: a first oil passage formed in the cam housing; a second oil passage formed in an outer wall upper portion of the cylinder head so as to communicate with the first oil passage; and a pipe connection portion formed so as to allow an oil pipe to be connected to the second oil passage from an outside.

Preferably, a main gallery of the lubricating oil is provided on the crankcase, and the main gallery and the pipe connection portion of the second oil passage are connected to each other via an external oil pipe provided outside the crankcase and the cylinder block.

Preferably, the first oil passage communicates with an oil jet hole for supplying the lubricating oil to a tappet forming the valve driving device.

Preferably, the first oil passage is formed linearly so as to be parallel to an axial direction of the camshaft, and the second oil passage is connected to one end of the first oil passage.

DETAILED DESCRIPTION OF THE PREFERRED EMBODIMENTS

Figure 1:
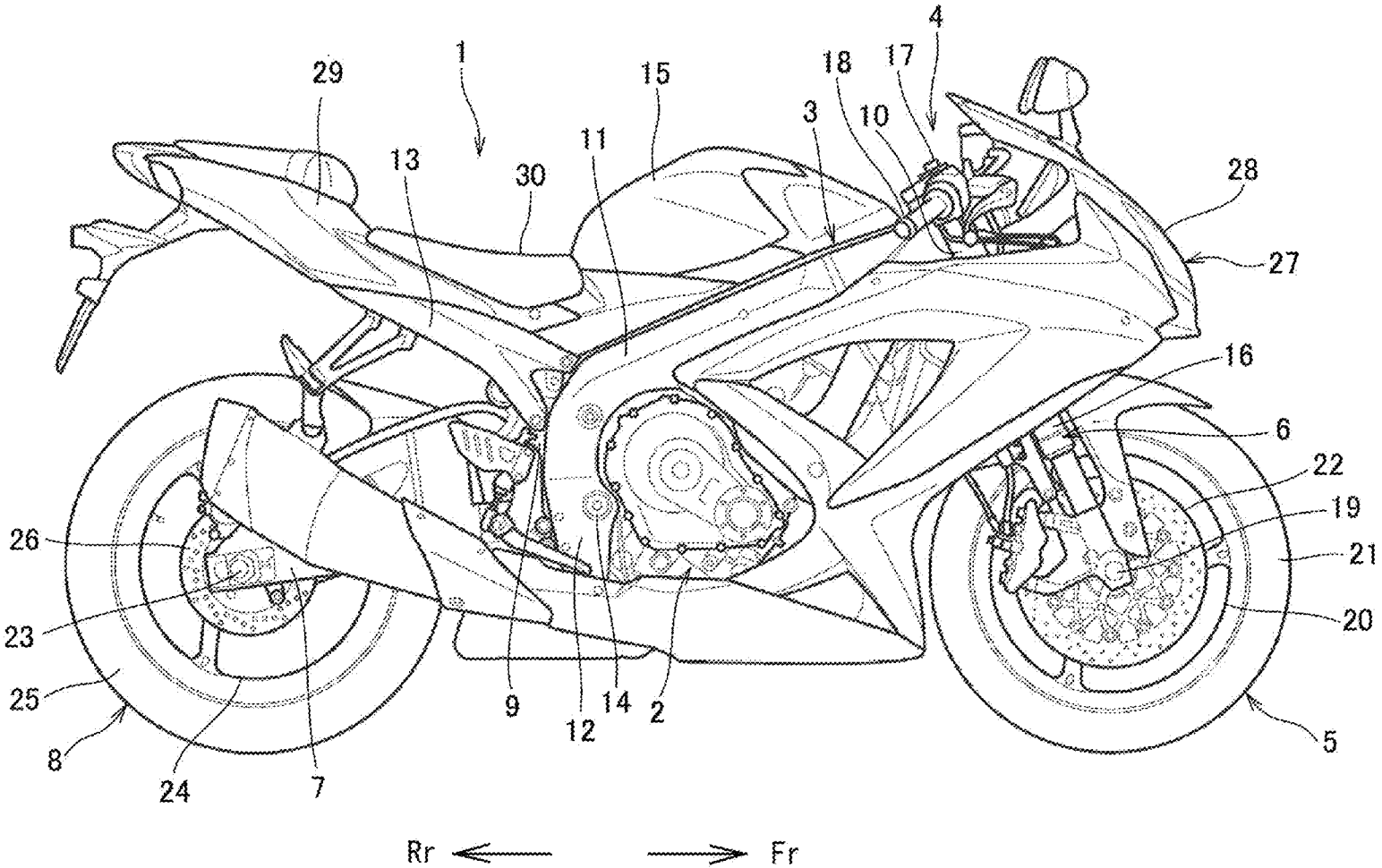
FIG. 1 is a right side view showing a motorcycle including a lubricating structure for an internal combustion engine according to an embodiment of the present invention.

Hereinafter, a lubricating structure for an internal combustion engine according to an embodiment of the present invention will be described in detail with reference to the drawings. The description below shows an example where the lubricating structure for the internal combustion engine according to the embodiment of the present invention is applied to an engine 2 of a motorcycle 1 as shown in FIG. 1. Further, in the following description, front and rear, left and right, and up and down directions of the motorcycle 1 and each part of the motorcycle 1 are based on directions seen by a rider riding the motorcycle 1. In these drawings, a front side, a rear side, a right side, and a left side of the motorcycle 1 are shown by an arrow Fr, an arrow Rr, an arrow R, and an arrow L respectively when necessary. It should be noted that an application target of the lubricating structure for the internal combustion engine according to the present invention is not limited to a motorcycle. The present invention is effectively applicable to various kinds of engines mounted on motorcycles, four-wheeled vehicles, and the like.

FIG. 1 is a right side view showing the motorcycle 1 including the lubricating structure for the internal combustion engine according to the embodiment of the present invention. The motorcycle 1 includes a body frame 3, the engine 2 as the internal combustion engine, a steering mechanism 4, a front tire/wheel assembly 5, a front suspension 6, a swing arm 7, a rear tire/wheel assembly 8, and a rear suspension 9. The engine 2 is mounted on the body frame 3. The steering mechanism 4 is pivotally supported on a front end portion of the body frame 3. The front tire/wheel assembly 5 is pivotally supported on a lower end portion of the steering mechanism 4. The front suspension 6 is provided on the steering mechanism 4. The swing arm 7 is pivotally supported on a rear portion of the body frame 3 so as to be swingable in the up and down direction. The rear tire/wheel assembly 8 is pivotally supported on a lower end portion of the swing arm 7. The rear suspension 9 is coupled between the body frame 3 and the swing arm 7.

As the body frame 3, a twin tube type is employed, for instance. The body frame 3 includes a head pipe 10, a pair of left and right main frames 11, a pair of left and right center frames 12, and a pair of left and right seat rails 13. The head pipe 10 is disposed at the front end portion of the body frame 3. The pair of left and right main frames 11 extends obliquely rear downward while widening in the left and right direction from a rear side of the head pipe 10. Further, the pair of left and right main frames 11 serves also as tank rails. The pair of left and right center frames 12 is provided integrally on rear end portions of the main frames 11 and extends substantially downward. The pair of left and right seat rails 13 extends obliquely rear upward from the rear end portions of the main frames 11.

The head pipe 10 pivotally supports the steering mechanism 4 via a steering shaft (not shown). The center frames 12 support a pivot shaft 14 suspended between their substantially center portions in terms of their longitudinal direction. The pivot shaft 14 pivotally supports the swing arm 7. The main frames 11 and the seat rails 13 support a fuel tank 15 from under.

The engine 2 is disposed at a center lower portion of the motorcycle 1 so as to be located under the main frames 11. A structure of the engine 2 will be described later.

The steering mechanism 4 is pivotally supported by the head pipe 10 and the steering shaft so as to be pivotable in the left and right direction of the motorcycle 1. The steering mechanism 4 includes a pair of left and right front forks 16 and a pair of handlebars 17. The pair of left and right front forks 16 is provided on a steering head pivotally supported by the steering shaft. The pair of handlebars 17 is provided near upper ends of the front forks 16 or on the steering head. The pair of left and right handlebars 17 each includes a handle grip 18. The handle grip 18 disposed on the right is a throttle grip.

The front tire/wheel assembly 5 includes a front wheel 20, a front tire 21, and a front brake plate 22. The front wheel 20 is pivotally supported on the front forks 16 via a front-wheel axle 19 and is steered by the handlebars 17 of the steering mechanism 4 so as to be pivotable left and right. The front tire 21 is fitted around an outer peripheral portion of the front wheel 20. The front brake plate 22 is fixed to the front wheel 20 by fastening members (not shown) such as bolts.

A front end portion of the swing arm 7 is pivotally supported by the pivot shaft 14. The pivot shaft 14 is provided between the substantially centers of the center frames 12 in terms of the up and down direction.

The rear tire/wheel assembly 8 includes a rear wheel 24, a rear tire 25, and a rear brake plate 26. The rear wheel 24 is pivotally supported on the swing arm 7 via a rear-wheel axle 23. The rear tire 25 is fitted around an outer peripheral portion of the rear wheel 24. The rear brake plate 26 is fixed to the rear wheel 24 by fastening members (not shown) such as bolts.

The rear suspension 9 is a shock absorbing device which prevents an up and down direction vibration of the swing arm 7 due to bumps of a road surface held by the rear tire/wheel assembly 8 from being transmitted to the body frame 3. The rear suspension 9 also functions to press the rear tire/wheel assembly 8 against a road surface. The rear suspension 9 includes a suspension unit including the combination of a spring and a shock absorber (neither is shown).

Further, in the motorcycle 1, at least part of the vehicle, for example, a portion from its front portion up to its center lower portion is covered by a cowling 27 in a streamline shape. The cowling 27 is formed so as to reduce air resistance while the motorcycle 1 is running and so as to protect a rider from a running air pressure. The cowling 27 includes a front cover 28 covering the front portion of the vehicle and a seat cowl 29 covering a rear portion of the vehicle. Further, the seat cowl 29 supports a seating seat 30.

Figure 2:
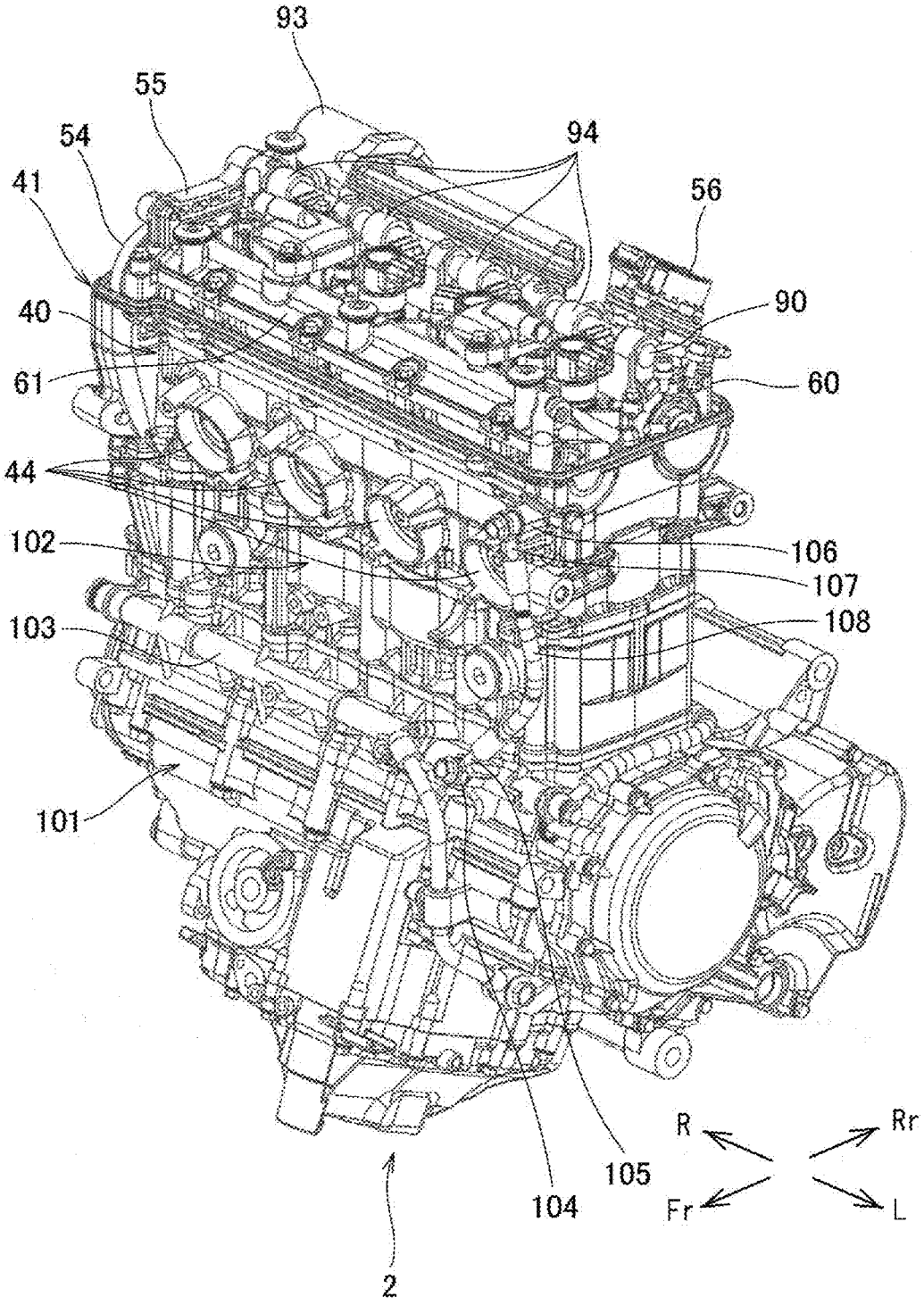
FIG. 2 is a perspective view showing an engine including the lubricating structure for the internal combustion engine according to the embodiment of the present invention.
Figure 3:
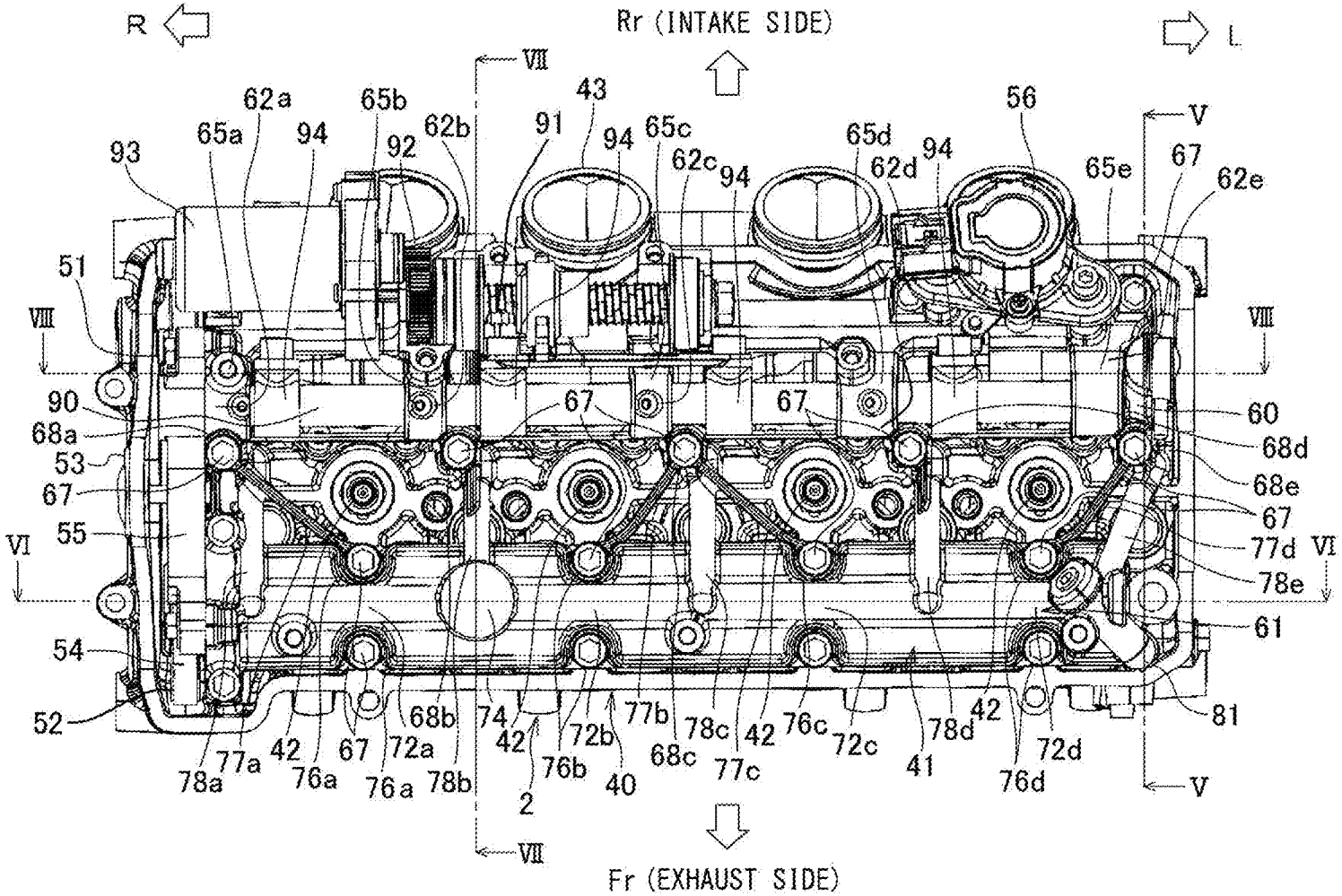
FIG. 3 is a plane view showing the engine including the lubricating structure for the internal combustion engine according to the embodiment of the present invention.
Figure 4:
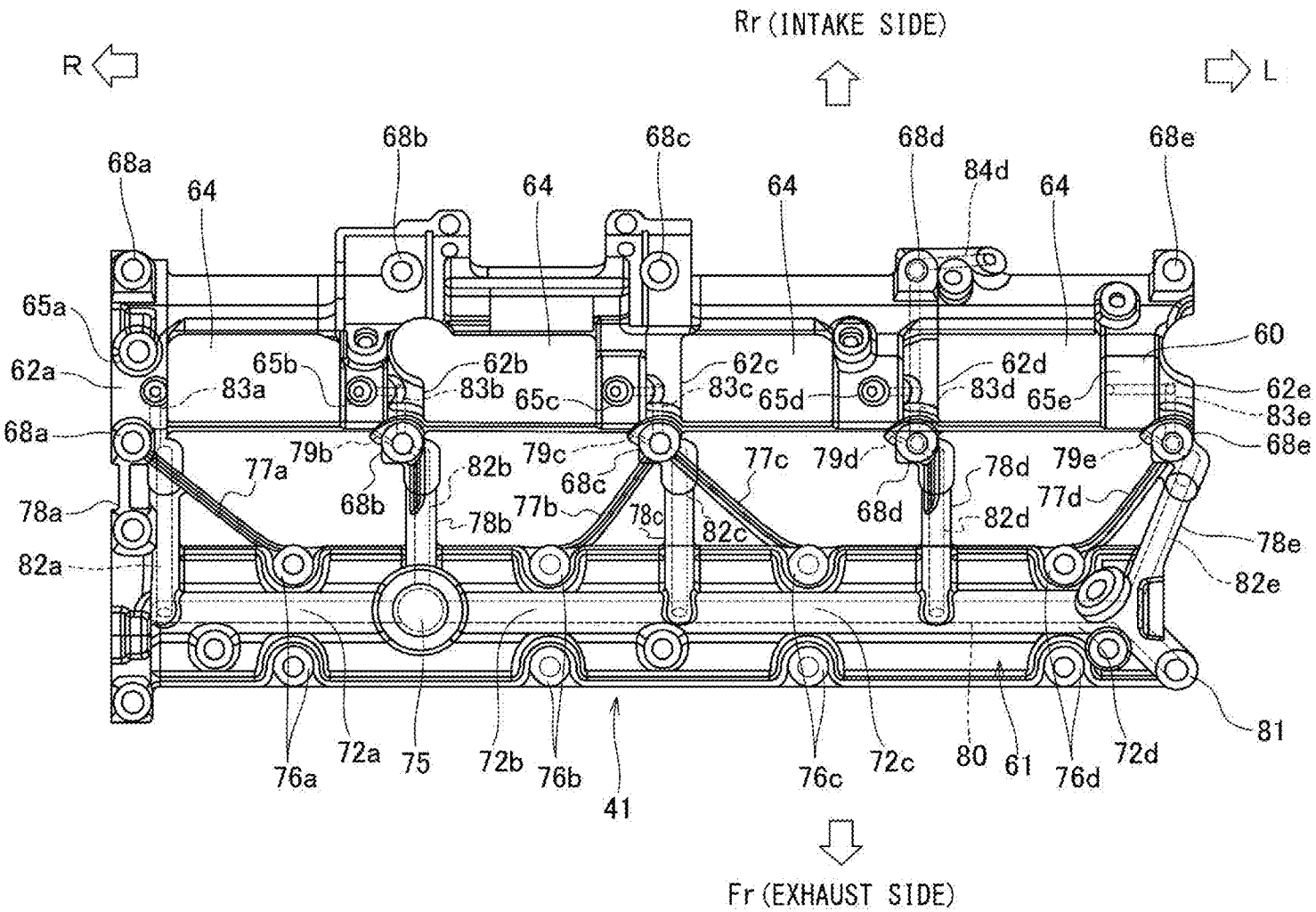
FIG. 4 is a plane view showing a cam housing including the lubricating structure for the internal combustion engine according to the embodiment of the present invention.
Figure 5:
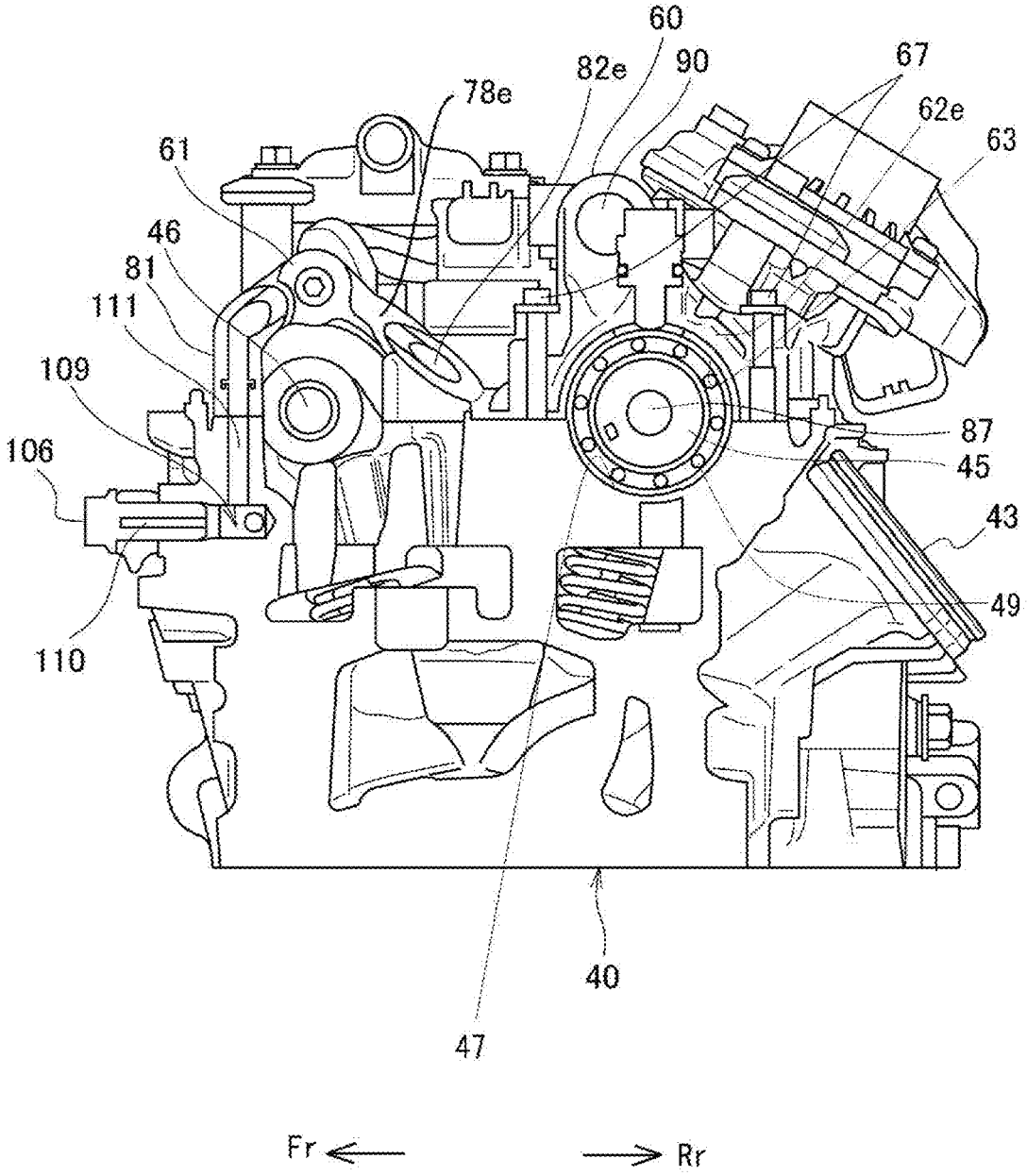
FIG. 5 is a cross-sectional view taken along the V-V line in FIG. 3.
Figure 6:
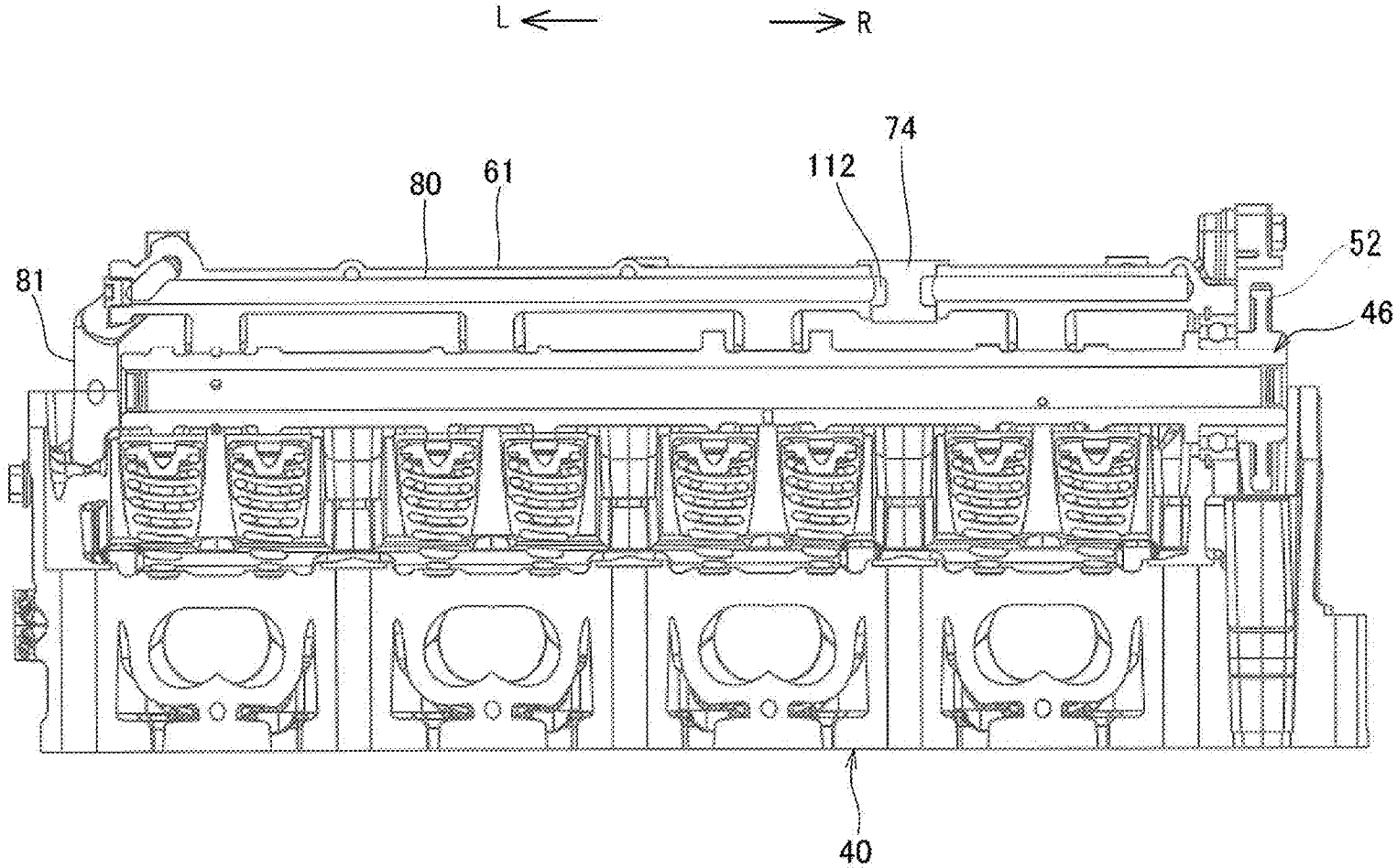
FIG. 6 is a cross-sectional view taken along the VI-VI line in FIG. 3.
Figure 7:
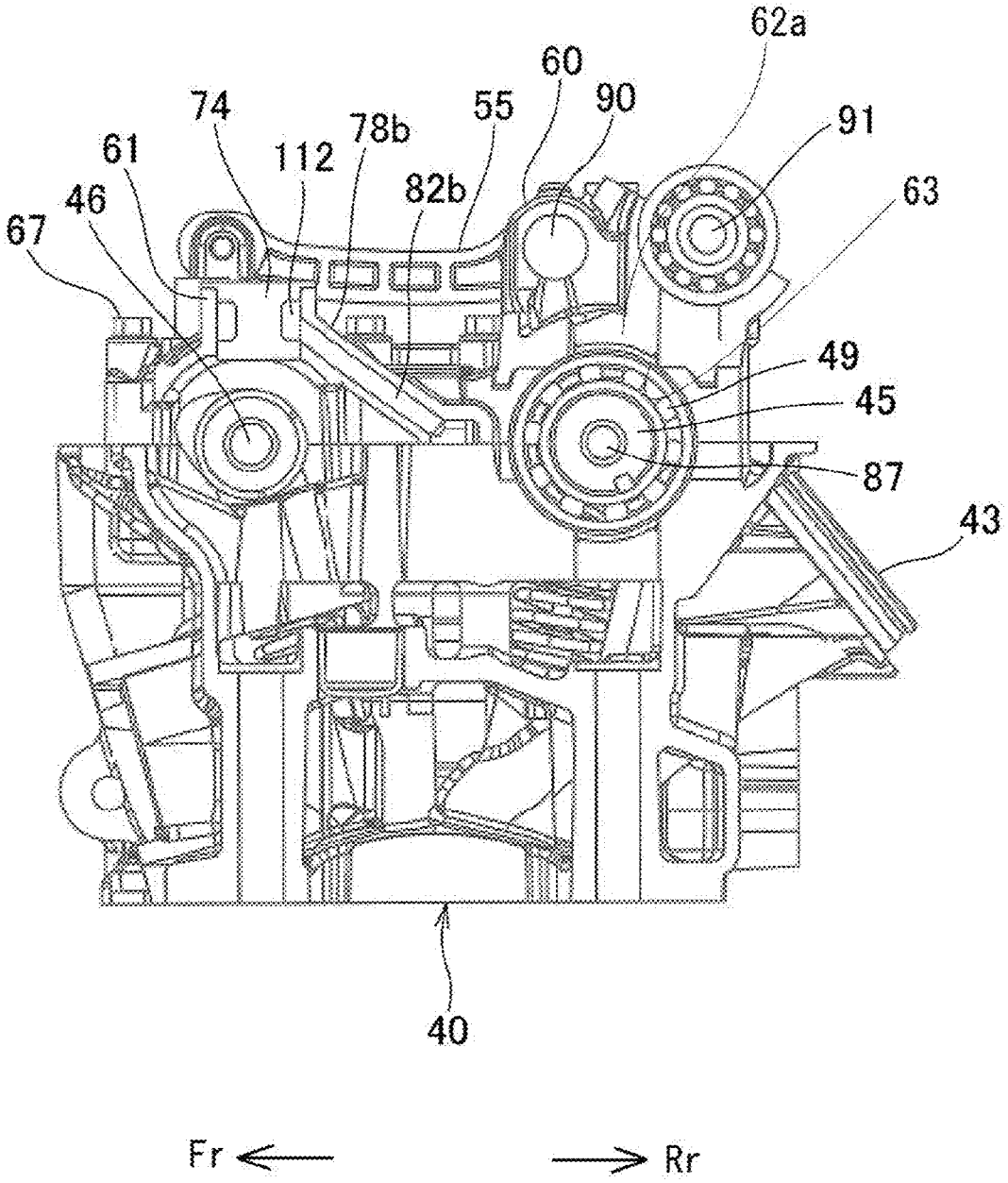
FIG. 7 is a cross-sectional view taken along the VII-VII line in FIG. 3.
Figure 8:
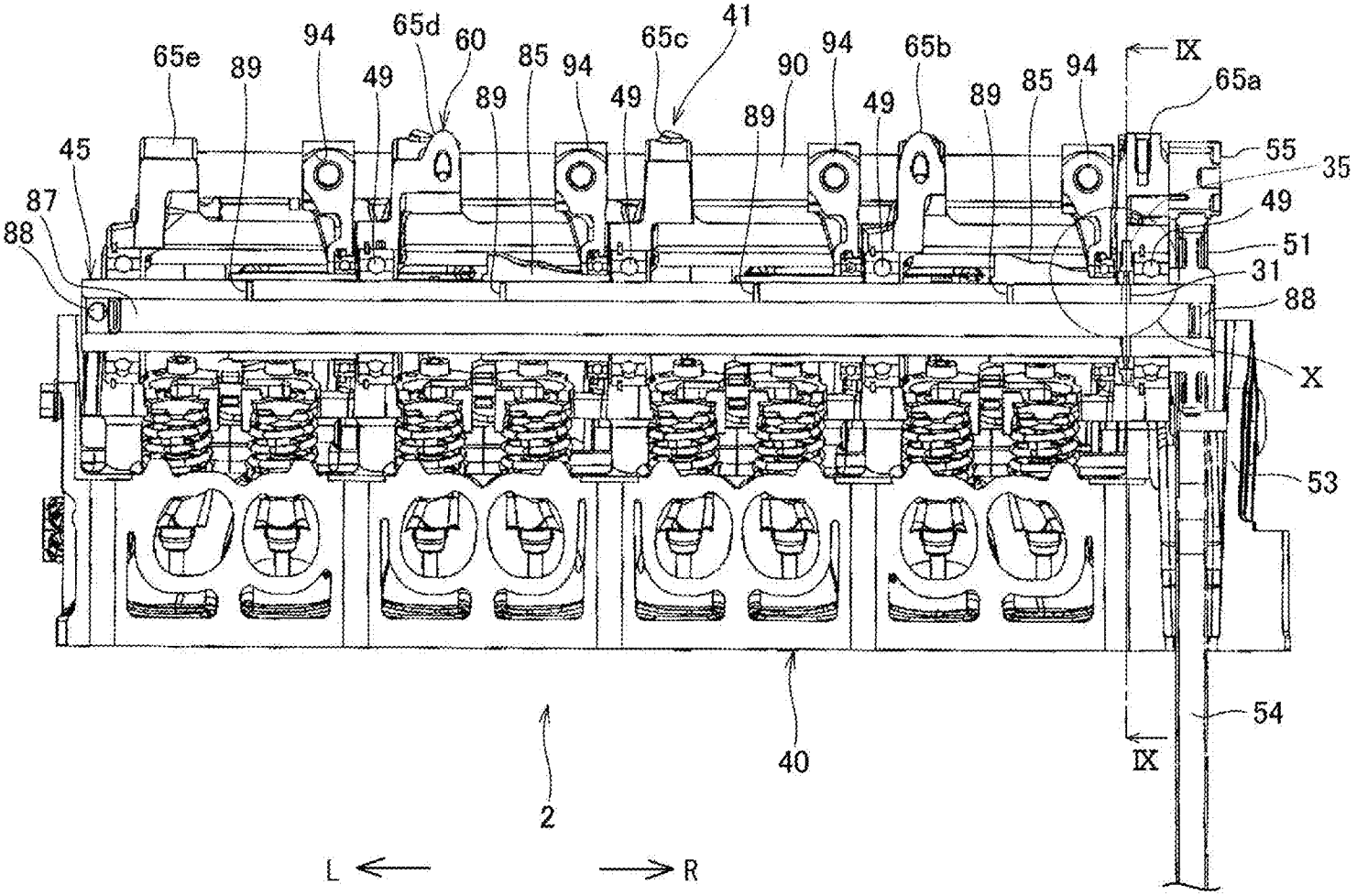
FIG. 8 is a cross-sectional view taken along the VIII-VIII line in FIG. 3.
Figure 9:
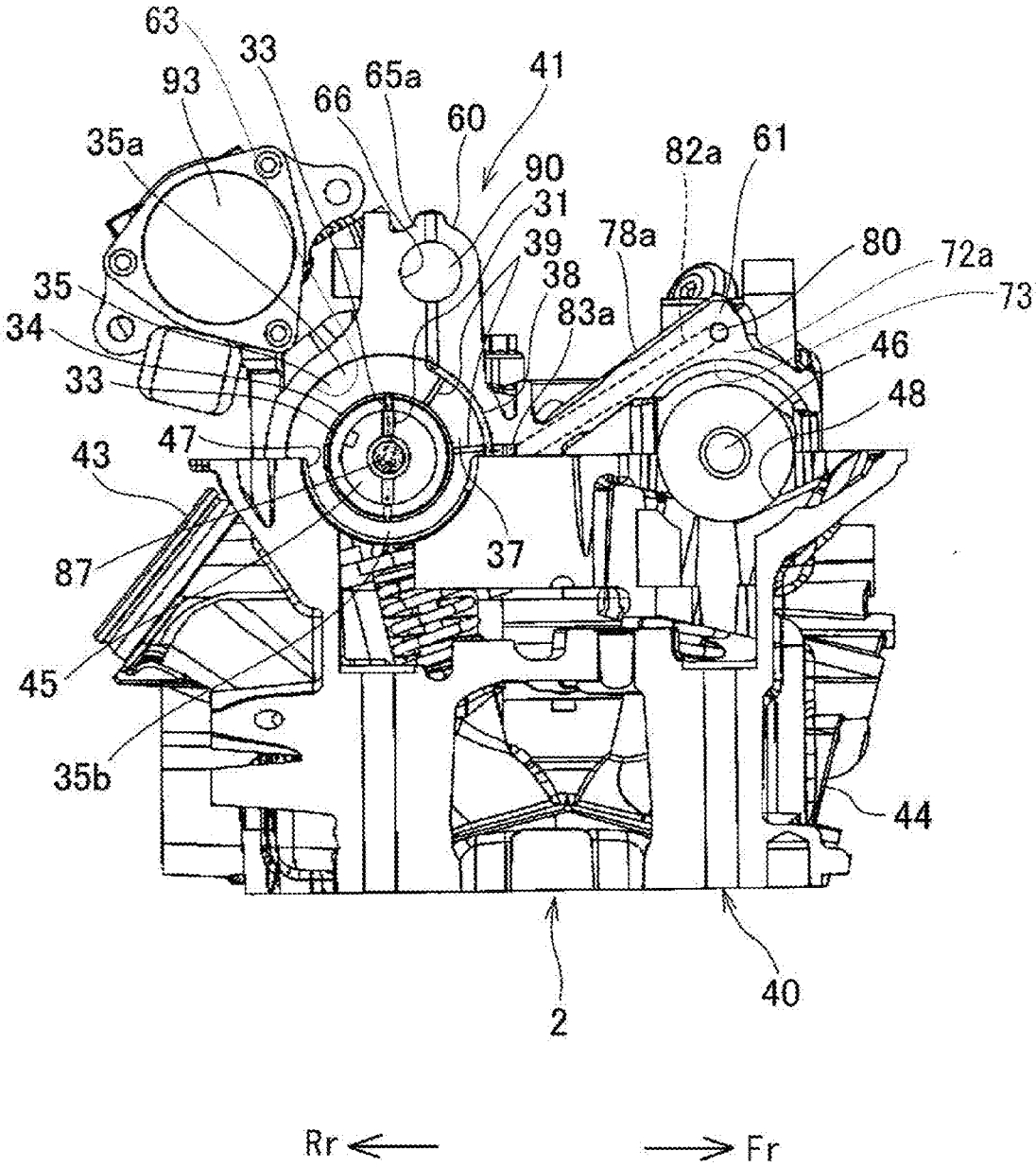
FIG. 9 is a cross-sectional view taken along the IX-IX line in FIG. 8.
Figure 10:
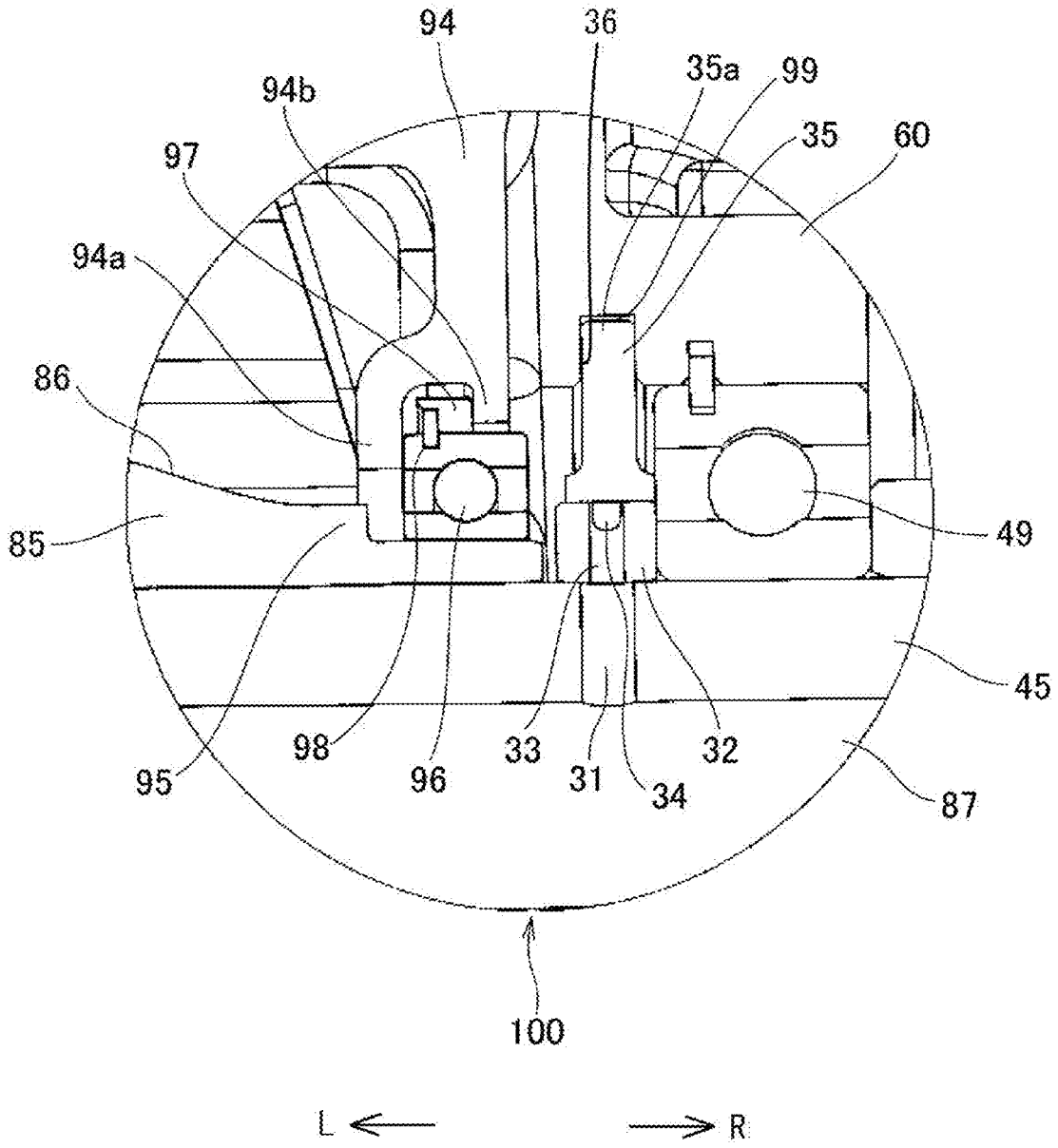
FIG. 10 is an enlarged view of the X portion in FIG. 8.

Next, the engine 2 including the lubricating structure for the internal combustion engine according to the embodiment of the present invention will be described in detail with reference to FIG. 2 to FIG. 10. FIG. 2 is a perspective view showing the engine 2 including the lubricating structure for the internal combustion engine according to the embodiment of the present invention. FIG. 3 is a plane view showing the engine 2, with a head cover and a ball screw cover being removed. FIG. 4 is a plane view showing a cam housing. FIG. 5 is a cross-sectional view taken along the V-V line in FIG. 3. FIG. 6 is a cross-sectional view taken along the VI-VI line in FIG. 3. FIG. 7 is a cross-sectional view taken along the VII-VII line in FIG. 3. FIG. 8 is a cross-sectional view taken along the VIII-VIII line in FIG. 3. FIG. 9 is a cross-sectional view taken along the IX-IX line in FIG. 8. FIG. 10 is an enlarged view of the X portion in FIG. 8.

As shown in FIG. 2, the engine 2 as the internal combustion engine includes a crankcase 101, a cylinder block 102, a cylinder head 40, a cam housing 41, and a head cover (not shown). In the crankcase 101 a not-shown crankshaft is rotatably housed and supported. On an inner lower portion of the crankcase 101, an oil pan (not shown) capable of storing a lubricating oil is provided. The cylinder block 102 is provided on an upper side of the crankcase 101, and inside the cylinder block 102, a predetermined number of combustion chambers (cylinders) are formed. Inside each of the cylinders, a piston (not shown) is reciprocatably housed. The cylinder head 40 is provided on an upper surface of the cylinder block 102 and houses a valve driving device 100. The cam housing 41 is provided on an upper portion of the cylinder head 40. The head cover covers the cylinder head 40 and an upper side of the cam housing 41. As the engine 2, a four-cylinder engine is employed, for instance. The four combustion chambers are formed so as to line up in parallel in a width direction of the motorcycle 1 (left and right direction).

Besides, the engine 2 is provided with an oil pump and an oil filter (neither is shown). The oil pump draws up the lubricating oil stored in the oil pan of the crankcase 101 to pump the lubricating oil. The oil filter filtrates and cleans the lubricating oil pumped from the oil pump.

A main gallery 103 is disposed on an upper front portion of the crankcase 101. The main gallery 103 has a cylindrical structure and is disposed so that its axis is parallel to the left and right direction. The main gallery 103 is supported by a front outer wall of the crankcase 101. The oil pan of the crankcase 101 and the main gallery 103 are connected to each other so that the lubricating oil can flow from the former to the latter via the oil pump and the oil filter. With this structure, the lubricating oil drawn up by the oil pump from the oil pan of the crankcase 101 flows into the main gallery 103 after being filtrated by the oil filter (not shown).

A short pipe 104 is provided at one end portion (left side in this embodiment) of the main gallery 103. The short pipe 104 branches from the main gallery 103 to project forward. On an upper portion of the short pipe 104, a pipe connection portion 105 is provided so as to project upward.

A short pipe 106 is provided at one end portion (left end portion in this embodiment) of a front upper portion of the cylinder head 40. The short pipe 106 projects forward from a front wall surface of the cylinder head 40. On a lower portion of the short pipe 106, a pipe connection portion 107 is provided so as to project downward.

The pipe connection portion 107 of the cylinder head 40 and the pipe connection portion 105 of the main gallery 103 are connected to each other by an external oil pipe 108 having flexibility. The external oil pipe 108 is disposed so as to extend in the up and down direction at the front of the cylinder block 102 and the one end portion of the cylinder head 40. Incidentally, as shown in FIG. 2, the external oil pipe 108 is provided outside the crankcase 101 and the cylinder block 102.

As shown in FIG. 5, inside an upper portion of the front outer wall of the cylinder head 40, an oil passage 109 communicating with the main gallery 103 is formed. The oil passage 109 is composed of a front-rear passage portion 110 and an up-down passage portion 111. The front-rear passage portion 110 extends in the front and rear direction and its front end portion is connected to the short pipe 106. The up-down passage portion 111 is perpendicularly connected to a rear upper portion of the front-rear passage portion 110.

As shown in FIG. 3, in a substantially center portion of the cylinder head 40 in terms of the front and rear direction, four spark plugs 42 are arranged in the left and right direction at equal intervals. In the cylinder head 40, intake ports 43 and exhaust ports 44 are formed on a rear side and a front side respectively to sandwich these spark plugs 42. As shown in FIG. 9, the intake ports 43 open rear obliquely upward. The exhaust ports 44 open front obliquely downward.

As shown in FIG. 9, on the upper portion of the cylinder head 40, a plurality of intake-side camshaft bearing portions 47 and a plurality of exhaust-side camshaft bearing portions 48 are formed. The intake-side camshaft bearing portions 47 and the exhaust-side camshaft bearing portions 48 both have a semicircular concave structure opening upward in a left and right direction view. The plural intake-side camshaft bearing portions 47 are formed so as to line up in series in the left and right direction at the rear of the spark plugs 42. Further, the plural exhaust-side camshaft bearing portions 48 are formed so as to line up in series in the left and right direction in front of the spark plugs 42. The intake-side camshaft bearing portions 47 and the exhaust-side camshaft bearing portions 48 are formed at positions deviating from each other in terms of the left and right direction. That is, the plural intake-side camshaft bearing portions 47 and the plural exhaust-side camshaft bearing portions 48 are disposed zigzag across the spark plugs 42. The intake-side camshaft bearing portions 47 support an intake-side camshaft 45 from under. Similarly, the exhaust-side camshaft bearing portions 48 support an exhaust-side camshaft 46 from under. The intake-side camshaft 45 and the exhaust-side camshaft 46 are parallel to each other with their axes being parallel to the left and right direction. As shown in FIG. 3, an intake-side cam sprocket 51 is integrally and rotatably attached to the other end portion (right end portion in this embodiment) of the intake-side camshaft 45. Further, an exhaust-side sprocket 52 is integrally and rotatably attached to the other end portion of the exhaust-side camshaft 46. A drive sprocket (not shown) is integrally and rotatably attached to the crankshaft. A timing chain 54 is wound around the intake-side camshaft 45, the exhaust-side camshaft 46, and the drive sprocket. The intake-side camshaft 45 and the exhaust-side camshaft 46 are driven to rotate in synchronization with the rotation of the crankshaft. Above the timing chain 54, a timing chain guide 55 is disposed. The timing chain 54 properly runs by being guided by the timing chain guide 55. Incidentally, the timing chain 54 is covered by a chain case 53.

Besides, as shown in FIG. 2, a cam position sensor 56 which detects the rotation of the intake-side cam sprocket 51 is attached to the cylinder head 40.

As shown in FIG. 4, the cam housing 41 includes an intake-side cam housing 60 and an exhaust-side cam housing 61. The intake-side cam housing 60 is located above the intake-side camshaft 45 supported by the cylinder head 40. The exhaust-side cam housing 61 is located above the exhaust-side camshaft 46 supported by the cylinder head 40.

In the intake-side cam housing 60, a first to a fifth intake-side support portion 62*a*, 62*b*, 62*c*, 62*d*, 62*e* are formed in order from the other end portion toward the one end portion (right to left in this embodiment). The first to fifth intake-side support portions 62*a*, 62*b*, 62*c*, 62*d*, 62*e* are formed at positions corresponding to the intake-side camshaft bearing portions 47 of the cylinder head 40 respectively. The intake-side support portions 62*a*, 62*b*, 62*c*, 62*d*, 62*e* are integrally coupled to one another. Further, between each two of the intake-side support portions 62*a*, 62*b*, 62*c*, 62*d*, 62*e*, an opening portion 64 is formed so as to correspond to a slide range of a later-described cam fork 94.

As shown in FIG. 5, on lower portions of the intake-side support portions 62*a*, 62*b*, 62*c*, 62*d*, 62*e*, upward concave portions 63 capable of pivotally supporting the intake-side camshaft 45 from above are formed. The upward concave portions 63 have a semicircular concave structure opening downward in a left and right direction view. Note that in FIG. 5, the fifth intake-side support portion 62*e* is shown but the first to fourth intake-side support portions 62*a* to 62*d* also have the same structure. Therefore, the intake-side support portions 62*a*, 62*b*, 62*c*, 62*d*, 62*e* are capable of pivotally supporting the intake-side camshaft 45 from above. The intake-side camshaft 45 is rotatably supported by bearings 49 put between inner sides of these upward concave portions 63 and the intake-side camshaft bearing portions 47.

As shown in FIG. 4, on upper portions of the intake-side support portions 62*a*, 62*b*, 62*c*, 62*d*, 62*e*, shaft bearing portions 65*a*, 65*b*, 65*c*, 65*d*, 65*e* are formed respectively. As shown in FIG. 5 and FIG. 9, in the shaft bearing portions 65*a*, 65*b*, 65*c*, 65*d*, 65*e*, cylindrical shaft bearing holes 66 whose axial directions are parallel to the left and right direction are formed respectively. A fork shaft 90 is inserted to the shaft bearing holes 66 so as to be slidable in its axial direction.

As shown in FIG. 3 and FIG. 9, on an upper portion of the intake-side cam housing 60, a motor 93, a ball screw 91, a gear group 92, and so on are attached at positions opposite the fork shaft 90 across the intake-side camshaft 45 (that is, a rear side) in a plane view. The motor 93, the ball screw 91, the gear group 92, and so on form a drive mechanism of the fork shaft 90. The fork shaft 90 is connected to an output shaft of the motor 93 via the ball screw 91 and the gear group 92. With this structure, the fork shaft 90 slides in its axial direction by a desired amount by the operation of the motor 93.

As shown in FIG. 3 and FIG. 4, intake-side fixing portions 68*a*, 68*b*, 68*c*, 68*d*, 68*e* are formed at front end portions and rear end portions of the intake-side support portions 62*a*, 62*b*, 62*c*, 62*d*, 62*e*. The intake-side fixing portions 68*a*, 68*b*, 68*c*, 68*d*, 68*e* have a structure allowing bolts 67 for fixing the intake-side cam housing 60 to the cylinder head 40 to be screwed thereto.

As shown in FIG. 3 and FIG. 4, in the exhaust-side cam housing 61, a first to a fourth exhaust-side support portion 72*a*, 72*b*, 72*c*, 72*d* are formed in order from the other end portion toward the one end portion at positions corresponding to the exhaust-side camshaft bearing portions 48 of the cylinder head 40 respectively. The exhaust-side support portions 72*a*, 72*b*, 72*c*, 72*d* are integrally coupled to one another. Between the first exhaust-side support portion 72*a* and the second exhaust-side support portion 72*b* on the other end portion side, a fitting concave portion 75 for an oil plug 74 in a columnar shape is formed.

As shown in FIG. 9, in the exhaust-side support portions 72*a*, 72*b*, 72*c*, 72*d*, upward concave portions 73 are formed respectively so as to be capable of pivotally supporting the exhaust-side camshaft 46 from above. The upward concave portions 73 have a semicircular concave structure opening downward in the left and right direction view. Note that in FIG. 9, the exhaust-side support portion 72*a* is shown but the upward concave portions 73 of the other exhaust-side support portions 72*b*, 72*c*, 72*d* also have the same structure. The exhaust-side camshaft 46 is rotatably supported by bearings 50 put between inner sides of these upward concave portions 73 and the exhaust-side camshaft bearing portions 48.

As shown in FIG. 3 and FIG. 4, exhaust-side fixing portions 76*a*, 76*b*, 76*c*, 76*d* are formed at front end portions and rear end portions of the exhaust-side support portions 72*a*, 72*b*, 72*c*, 72*d* respectively. The exhaust-side fixing portions 76*a*, 76*b*, 76*c*, 76*d* have a structure allowing bolts 67 for fixing the exhaust-side cam housing 61 to the cylinder head 40 to be screwed thereto.

As shown in FIG. 3 and FIG. 4, the exhaust-side fixing portion 76*a* at the rear end portion of the first exhaust-side support portion 72*a* is coupled to the intake-side fixing portion 68*a* at the front end portion of the first intake-side support portion 62*a* via a first reinforcing member 77*a* in a rib shape. The first reinforcing member 77*a* is suspended between the intake-side fixing portion 68*a* and the exhaust-side fixing portion 76*a*. The first reinforcing member 77*a* extends in an oblique direction relative to the front and rear direction and the left and right direction in a plane view.

The exhaust-side fixing portion 76*b* at the rear end portion of the second exhaust-side support portion 72*b* is coupled to the intake-side fixing portion 68*c* at the front end portion of the third intake-side support portion 62*c* via a second reinforcing member 77*b* in a rib shape. The exhaust-side fixing portion 76*c* at the rear end portion of the third exhaust-side support portion 72*c* is coupled to the intake-side fixing portion 68*c* at the front end portion of the third intake-side support portion 62*c* via a third reinforcing member 77*c* in a rib shape. That is, the second reinforcing member 77*b* is suspended between the intake-side fixing portion 68*c* and the exhaust-side fixing portion 76*b*. Further, the third reinforcing member 77*c* is suspended between the intake-side fixing portion 68*c* and the exhaust-side fixing portion 76*c*. The second reinforcing member 77*b* and the third reinforcing member 77*c* extend in oblique directions relative to the front and rear direction and the left and right direction, which directions are opposite in terms of the left and right direction, in a plane view. Therefore, the second reinforcing member 77*b* and the third reinforcing member 77*c* are arranged so as to form an inverse V-shape.

Thus, the third intake-side support portion 62*c* is disposed between the second exhaust-side support portion 72*b* and the third exhaust-side support portion 72*c* in terms of an axial direction of the camshafts 45, 46. The third intake-side support portion 62*c* is coupled to two exhaust-side support portions, that is, the second exhaust-side support portion 72*b* and the third exhaust-side support portion 72*c* via the second reinforcing member 77*b* and the third reinforcing member 77*c*. This can sufficiently enhance stiffness and strength of the cam housing 41.

The exhaust-side fixing portion 76*d* at the rear end portion of the fourth exhaust-side support portion 72*d* is coupled to the intake-side fixing portion 68*e* at the front end portion of the fifth intake-side support portion 62*e* via a fourth reinforcing member 77*d* in a rib shape. The fourth reinforcing member 77*d* is suspended between the intake-side fixing portion 68*e* and the exhaust-side fixing portion 76*d*. The fourth reinforcing member 77*d* extends in an oblique direction relative to the front and rear direction and the left and right direction, which direction is opposite the extension direction of the first reinforcing member 77*a* in terms of the left and right direction in a plane view.

As shown in FIG. 3 and FIG. 4, between the intake-side cam housing 60 and the exhaust-side cam housing 61, a first to a fifth coupling member 78*a*, 78*b*, 78*c*, 78*d*, 78*e* are provided in order from the other end portion side toward the one end portion. The intake-side cam housing 60 and the exhaust-side cam housing 61 are coupled to each other via the first to fifth coupling members 78*a*, 78*b*, 78*c*, 78*d*, 78*e*.

As shown in FIG. 9, the first to fifth coupling members 78*a*, 78*b*, 78*c*, 78*d*, 78*e* are formed so as to tilt downward from an upper portion of the exhaust-side cam housing 61 toward the intake-side cam housing 60. Further, ribs are provided on the first to fifth coupling members 78*a*, 78*b*, 78*c*, 78*d*, 78*e*. Note that in FIG. 9, the first coupling member 78*a* is shown but the second to fifth coupling members also have the same structure.

As shown in FIG. 3 and FIG. 4, the first coupling member 78*a* couples the other end portions (right end portions in this embodiment) of the intake-side cam housing 60 and the exhaust-side cam housing 61 in terms of the left and right direction to each other. The second coupling member 78*b* couples the intake-side fixing portion 68*b* at the front end portion of the second intake-side support portion 62*b* and the fitting concave portion 75. The third coupling member 78*c* couples the intake-side fixing portion 68*c* at the front end portion of the third intake-side support portion 62*c* and a portion, of the exhaust-side cam housing 61, between the second exhaust-side support portion 72*b* and the third exhaust-side support portion 72*c*. The fourth coupling member 78*d* couples the intake-side fixing portion 68*d* at the front end portion of the fourth intake-side support portion 62*d* and a portion, of the exhaust-side cam housing 61, between the third exhaust-side support portion 72*c* and the fourth exhaust-side support portion 72*d*. The fifth coupling member 78*e* couples one-side end portions (left end portions in this embodiment) of the intake-side cam housing 60 and the exhaust-side cam housing 61 in terms of the left and right direction.

As shown in FIG. 4 and FIG. 6, in a front and rear-direction center of the exhaust-side cam housing 61, a main oil passage 80 extending linearly in the left and right direction is formed. An upper end portion of a lead-in pipe 81 leading the lubricating oil from the cylinder head 40 is connected to one end portion of the main oil passage 80. As shown in FIG. 5, the lead-in pipe 81 is disposed so as to extend in the up and down direction. A lower end portion of the lead-in pipe 81 is connected to an upper end portion of the up-down passage portion 111 of the oil passage 109. Consequently, the oil passage 109 of the cylinder head 40 and the main oil passage 80 of the exhaust-side cam housing 61 communicate with each other.

As shown in FIG. 4, inside the first coupling member 78*a* and the third to fifth coupling members 78*c*, 78*d*, 78*e*, oil communication paths 82*a*, 82*c*, 82*d*, 82*e* directly communicating with the main oil passage are formed respectively. Further, as shown in FIG. 7, inside the second coupling member 78*b*, an oil communication path 82*b* communicating with the main oil passage 80 via an oil groove 112 formed in an outer peripheral surface of the oil plug 72 fitted to the fitting concave portion 75 is formed.

As shown in FIG. 4, inside the first to fifth intake-side support portions 62*a*, 62*b*, 62*c*, 62*d*, 62*e* of the intake-side cam housing 60, oil passages 83*a*, 83*b*, 83*c*, 83*d*, 83*e* are formed. Via the oil passages 83*a*, 83*b*, 83*c*, 83*d*, 83*e*, the oil communication paths 82*a*, 82*b*, 82*c*, 82*d*, 82*e* communicate with the shaft bearing holes 66 of the shaft bearing portions 65*a*, 65*b*, 65*c*, 65*d*, 65*e* respectively.

Further, as shown in FIG. 4, inside the second to fifth intake-side support portions 62*b*, 62*c*, 62*d*, 62*e*, oil jet holes 79*b*, 79*c*, 79*d*, 79*e* for supplying the lubricating oil to tappets (not shown) forming the valve driving device of the cylinder head 40 are formed.

Further, inside the fourth intake-side support portion 62*d*, an oil passage 84*d* for supplying the lubricating oil to a shaft in a case of the cam position sensor 56 is formed.

As shown in FIG. 8, the intake-side camshaft 45 extends over the four cylinders. Four cams 85 corresponding to the respective four cylinders are put around the intake-side camshaft 45. As the cams 85, three-dimensional cams are employed. The cams 85 each have a cam surface 86 tilting relatively to the axial direction of the intake-side camshaft 45. The cam surfaces 86 are formed in such a shape as to continuously vary a valve lift amount. In this case, the cam surfaces 86 of the cams 85 are each formed so that a cam action angle and a lift timing also change simultaneously with a change of a cam height. Concretely, the cam surfaces 86 are set so that in accordance with an increase in the valve lift amount, the cam action angle increases and further the lift timing of the valve can also change.

Between the intake-side camshaft 45 and the cams 85, keys (not shown) are interposed. The keys not only restrict the rotation of the cams 85 relative to the intake-side camshaft 45 but also enable the cams 85 to slide in the axial direction along the intake-side camshaft 45.

As shown in FIG. 8, the intake-side camshaft 45 has a hollow structure and the inside of the hollow serves as an oil passage 87. Both left and right end portions of the oil passage 87 are closed by plugs 88 respectively. Further, in the intake-side camshaft 45, cam oil holes 89 extending in a diameter direction to make the inside and the outside communicate with each other are bored in correspondence with mounting positions of the cams 85 respectively.

As shown in FIG. 8 to FIG. 10, in one end portion of the intake-side camshaft 45, another oil hole 31 is bored. A camshaft ring 32 is fitted around the intake-side camshaft 45 at a position corresponding to the other oil hole 31. A camshaft ring oil hole 33 is bored in the camshaft ring 32 so as to match the other oil hole 31. Further, in an outer peripheral surface of the camshaft ring 32, an annular camshaft ring oil groove 34 extending in a circumferential direction is formed. The camshaft ring oil groove 34 communicates with the camshaft ring oil hole 33.

Incidentally, the camshaft ring 32 does not necessarily have to be disposed. When the camshaft ring 32 is not disposed, the camshaft ring oil groove 34 is formed in an outer peripheral surface of the intake-side camshaft 45.

An oil supply ring 35 is loosely fitted around the outer periphery of the camshaft ring 32. An upper half portion 35*a* of the oil supply ring 35 is fitted in an annular groove portion 36 formed in the upward concave portion 63 of the intake-side cam housing 60.

As shown in FIG. 9, a small-diameter portion 37 cut in an arc shape is formed in the upper half portion 35*a* of the oil supply ring 35. The small-diameter portion 37 is a portion whose diameter is smaller than that of the other portion of the upper half portion 35*a*. Between an outer peripheral surface of the small-diameter portion 37 and an inner peripheral surface of the annular groove portion 36, an oil passage 38 in an arc shape is formed. The oil passage 38 forms part of the oil passage 83*a* of the first intake-side support portion 62*a*. Further, in the oil supply ring 35, an oil supply ring oil hole 39 extending in the diameter direction is formed so as to make the oil passage 38 and the camshaft ring oil groove 34 communicate with each other. Incidentally, the number of the oil supply ring holes 39 is two in FIG. 9, but may be one or three or more.

A lower half portion 35*b* of the oil supply ring 35 has a semicircular shape whose diameter is still smaller than that of the small-diameter portion 37 of the upper half portion 35*a*. The lower half portion 35*b* of the oil supply ring 35 is fitted in the intake-side camshaft bearing portion 47 of the cylinder head 40. This structure restricts the rotation of the oil supply ring 35. Further, as shown in FIG. 10, a clearance 99 is formed between an outer peripheral surface of the oil supply ring 35 and the inner peripheral surface of the annular groove portion 36 of the intake-side cam housing 60.

As shown in FIG. 8, the four cam forks 94 corresponding to the respective cams 85 are supported by the fork shaft 90. The cam forks 94 are provided to be slidable in their axial direction integrally with the fork shaft 90. The cam forks 94 extend toward the intake-side camshaft 45 in a direction perpendicular to the axial direction of the fork shaft 90. As shown in FIG. 8 and FIG. 10, tip portions 94*a*, 94*b* of the cam forks 94 are formed in a bifurcated shape in the axial direction.

As shown in FIG. 10, a ball bearing 96 is put on an outer periphery of an end portion 95, of each of the cams 85, whose cam height is lower (low lift side) so as to be interposed between the outer periphery of the end portion 95 and the cam fork 94. The cam surface 86 side-tip portion 94*a* of the cam fork 94 abuts on a cam surface 86-side end surface of the ball bearing 96. Part of the tip portion 94*a* is formed so as to overlap with the low lift side of the cam surface 86.

A bearing ring 97 is put on a diameter-direction outer side of the ball bearing 96 via a C-ring 98. The tip portion 94*b*, of the cam fork 94, on a side distant from the cam surface 86 abuts on an end surface, of the baring 97, opposite the cam surface 86.

Consequently, in linkage with or in synchronization with the axial-direction sliding of the fork shaft 90, the cams 85 slide along the intake-side camshaft 45.

Since the basic structure of the vicinity of the exhaust-side camshaft 46 is the same as the above-described structure of the vicinity of the intake-side camshaft 45, and therefore a detailed description of its structure will be omitted.

In the engine 2 having the above-described structure, when a driver operates the throttle grip, a not-shown ECU (Engine Control Unit) detects this operation and puts the motor 93 into operation according to an operation amount and the like. The rotation of the output shaft of the motor 93 is transmitted to the fork shaft 90 via the ball screw 91 and the gear group 92. Then, the fork shaft 90 slides in its axial direction by a desired amount. In accordance with the sliding movement of the fork shaft 90, the cam forks 94 slide in the axial direction of the fork shaft 90 in the cylinders. Consequently, the cams 85 slide along the intake-side camshaft 45. In this manner, the valve lift amount and the action angle are variably controlled in a continuous manner according to an accelerator opening degree. Then, intake and exhaust amounts are suitably controlled from an idle rotation range up to a full open range, so that the intake and exhaust which are optimum for an engine speed (or vehicle speed) take place.

At this time, the oil pump (not shown) draws up the lubricating oil from the oil pan (not shown) provided in the crankcase 101 to pump the lubricating oil. The pumped lubricating oil flows into the main gallery 103 after being filtrated by the oil filter (not shown) (see FIG. 2). The lubricating oil flowing into the main gallery 103 passes through the external oil pipe 108 (see FIG. 2), the oil passage 109 (see FIG. 5) in the cylinder head 40, and the lead-in pipe 81 (see FIG. 4 to FIG. 6) in sequence to flow into the main oil passage 80 (see FIG. 4). The lubricating oil flowing into the main oil passage 80 passes through the oil communication paths 82*a*, 82*b*, 82*c*, 82*d*, 82*d*, 82*e* and the oil passages 83*a*, 83*b*, 83*c*, 83*d*, 83*e* of the first to fifth intake-side support portions 62*a*, 62*b*, 62*c*, 62*d*, 62*e* to be supplied to the shaft bearing holes 66 of the shaft bearing portions 65*a*, 65*b*, 65*c*, 65*d*, 65*e*.

Further, as shown in FIG. 8 to FIG. 10, the lubricating oil flowing into the oil passage 83*a* of the first intake-side support portion 62*a* passes through the oil passage 38 in the arc shape, the oil supply ring oil hole 39, the camshaft ring oil groove 34, the camshaft ring oil hole 33, and the oil hole 31 of the intake-side camshaft 45 to flow into the oil passage 87 of the intake-side camshaft 45. Then, the lubricating oil flowing into the oil passage 87 passes through the cam oil holes 89 to be supplied between the cams 85 of the intake-side camshaft 45 (see FIG. 8).

Further, as shown in FIG. 4, the lubricating oil flowing into the oil communication paths 82*a*, 82*b*, 82*c*, 82*d*, 82*e* is supplied to the tappets forming the valve driving device 100 of the cylinder head 40 via the oil jet holes 79*b*, 79*c*, 79*d*, 79*e* in the second to fifth intake-side support portions 62*b*, 62*c*, 62*d*, 62*e*, Further, the lubricating oil is supplied to the shaft in the case of the cam position sensor 56 via the oil passage 84*d* in the fourth intake-side support portion 62*d*.

In this manner, the lubricating oil is easily and surely supplied to the mechanisms for driving the intake-side camshaft 45 and the cams 85.

Effects of the lubricating structure for the internal combustion engine according to the above-described embodiment of the present invention are as follows.

As shown in FIG. 2, the main gallery 103 and the oil passage 109 of the cylinder head 40 are connected to each other via the external oil pipe 108. This structure makes it possible to shorten a route from the main gallery 103 up to the oil passage 109 and to reduce the number of bending portions. This can reduce resistance when the lubricating oil flows through the external oil pipe 108. Therefore, it is possible to efficiently supply the lubricating oil to the valve driving device 100 and so on.

As shown in FIG. 2, the external oil pipe 108 is connected to the pipe connection portion 107 of the cylinder head 40 from the outside. The external oil pipe 108 is provided outside the crankcase 101 and the cylinder block 102. According to this structure, layout restriction is not likely to be imposed on the oil passage from the main gallery 103 up to the main oil passage 80. Therefore, it is possible to reduce the resistance when the lubricating oil flows through the oil passage, which enables the efficient supply of the lubricating oil to each part.

As shown in FIG. 6 and so on, the linear main oil passage 80 is formed in the exhaust-side cam housing 61. The main oil passage 80 is connected to the oil passage 109 of the cylinder head 40 via the lead-in pipe 81 connected to one end of the main oil passage 80. This structure can reduce a pressure loss of the oil passage, which enables the efficient supply of the lubricating oil to each part.

As shown in FIG. 8 to FIG. 10, between the intake-side camshaft 45 and the intake-side support portion 62*a*, the oil supply ring 35 is provided. Further, between the outer peripheral surface of the oil supply ring 35 and the inner peripheral surface of the intake-side support portion 62*a*, the oil passage 38 is formed. The oil passage 38 forms part of the oil passage 83*a* in the intake-side cam housing 60. The oil passage 83*a* communicates with the shaft bearing hole 66 of the shaft bearing portion 65*a* of the fork shaft 90 (especially see FIG. 9). This structure makes it possible to easily form the oil passage reaching the shaft bearing portion 65*a* without impairing stiffness and strength of the intake-side cam housing 60 due to the formation of the oil passage by working the intake-side cam housing 60 by a drill or the like. Further, it is possible to form the oil passage reaching the shaft bearing portion 65*a* as short as possible.

As shown in FIG. 8, in the oil supply rings 35 and the intake-side camshaft 45, the oil holes 31, 33, 39 extending toward the inside of the intake-side camshaft 45 from the oil passages 38 are formed so as to extend in the diameter direction. This structure facilitates and ensures not only the supply of the oil to the fork shaft 90 but also the supply of the oil to the intake-side camshaft 45.

As shown in FIG. 9, the oil passage 38 is formed by cutting the outer peripheral portion of the oil supply ring 35 in the arc shape. This structure can make the flow of the oil toward the fork shaft 90 smooth.

In the foregoing, the embodiment of the present invention is described in detail, but the above-described embodiment only shows a concrete example in carrying out the present invention. The technical scope of the present invention is not limited to the above-described embodiment. The present invention can be variously modified within the range not departing from its spirit and the modified forms are also included in the technical scope of the present invention.

For example, in the above-described embodiment, the mode where the present invention is applied to the motorcycle is shown, but an application target of the lubricating structure for the internal combustion engine according to the present invention is not limited to the motorcycle. The present invention is applicable to not only an engine mounted on a motorcycle but also to an engine mounted on a four-wheeled vehicle.

Further, in the above-described embodiment, the four-cylinder engine is shown, but the kind of the engine to which the present invention is applied is not limited either.

According to the present invention, the oil pipe is connected to the pipe connection portion of the second oil passage from the outside. Therefore, the layout restriction is not likely to be imposed on the oil passage reaching the first passage. Therefore, it is possible to reduce resistance when the lubricating oil flows through the oil passage, which enables the efficient supply of the lubricating oil to each part.

The present invention is suitable for a lubricating structure for an internal combustion engine. According to the present invention, it is possible to reduce resistance when a lubricating oil flows through an oil passage, which enables the efficient supply of the lubricating oil to each part.

What is claimed is:

1. A lubricating structure for an internal combustion engine which has a crankcase, a cylinder block, a cylinder head housing a valve driving device, and a cam housing provided on an upper portion of the cylinder head to support a camshaft, the lubricating structure comprising:

a first oil passage formed in the cam housing;

a second oil passage formed in an outer wall upper portion of the cylinder head so as to communicate with the first oil passage;

a pipe connection portion formed at an outer surface of the cylinder head; and an oil pipe provided to the outer surface of the cylinder head, wherein the pipe connection portion allows the oil pipe to be connected to the second oil passage from an outside.

2. The lubricating structure for the internal combustion engine according to claim 1, wherein:

a main gallery of lubricating oil is provided on the crankcase; and the main gallery and the pipe connection portion of the second oil passage are connected to each other via an external oil pipe provided outside the crankcase and the cylinder block.

3. The lubricating structure for the internal combustion engine according to claim 1, wherein the first oil passage communicates with an oil jet hole for supplying lubricating oil to a tappet forming the valve driving device.

4. The lubricating structure for the internal combustion engine according to claim 1, wherein:

the first oil passage is formed linearly so as to be parallel to an axial direction of the camshaft; and the second oil passage is connected to one end of the first oil passage.

* * * * *